United States Patent [19]

Benyák et al.

[11] 4,366,106

[45] Dec. 28, 1982

[54] HEAT EXCHANGER

[75] Inventors: Istvan Benyák, Tata; Lajos Dudás; Oszkár Pohl, both of Budapest, all of Hungary

[73] Assignees: Hutotechnika Ipari Szovetkezet, Tata; Villamosenergiaipari Kutato Intezet, Budapest, both of Hungary

[21] Appl. No.: 271,031

[22] Filed: Jun. 4, 1981

[30] Foreign Application Priority Data

Jun. 12, 1980 [HU] Hungary ..... 1474

[51] Int. Cl.[3] ..... B01F 3/04

[52] U.S. Cl. ..... 261/156; 165/60; 165/178; 165/182; 261/152

[58] Field of Search ..... 261/152, 156, DIG. 41, 261/153–155, 157, DIG. 11, DIG. 77; 165/182, 178, 60; 248/68 R, 68 CB; 62/304, 484

[56] References Cited

U.S. PATENT DOCUMENTS

| | | | |
|---|---|---|---|
| 159,998 | 2/1875 | Beath | 261/152 X |
| 1,057,081 | 3/1913 | Neiman et al. | 165/182 X |
| 1,919,197 | 7/1933 | Bulkeley | 261/152 X |
| 2,023,739 | 12/1935 | Mason | 165/182 X |
| 2,153,267 | 4/1939 | Morse | 261/156 X |
| 2,475,187 | 7/1949 | Kramer | 165/182 X |
| 3,064,952 | 11/1962 | Brown | 261/152 X |
| 3,800,553 | 4/1974 | Engalitcheff, Jr. | 261/152 X |
| 4,173,998 | 11/1979 | Jahoda | 165/182 |

*Primary Examiner*—Richard L. Chiesa
*Attorney, Agent, or Firm*—Robert J. Patch

[57] ABSTRACT

A heat exchanger for the condensation of vapors, comprises a coil pipe having an upper inlet end and a lower outlet end and a plurality of lengths of pipe arranged in zigzag fashion between the upper and lower ends. Liquid is sprayed from above onto the coil pipe, and air is moved upwardly along the coil pipe. The lengths of pipe are inclined downwardly at acute angles to the horizontal from the inlet end to the outlet end. These acute angles progressively increase downwardly in such a way that the angles between pairs of adjacent lengths of pipe progressively increase downwardly for a plurality of those pairs. The inclination to the horizontal of the lowermost length of pipe is not more than 30° and that of the uppermost not less than 3–5°. The increment of angle increase, from pipe length to pipe length, is likewise 3–5°. Vertical strips of plate are disposed between the lengths of pipe, to increase the evaporation surface.

8 Claims, 7 Drawing Figures

HEAT EXCHANGER

Figure 1:
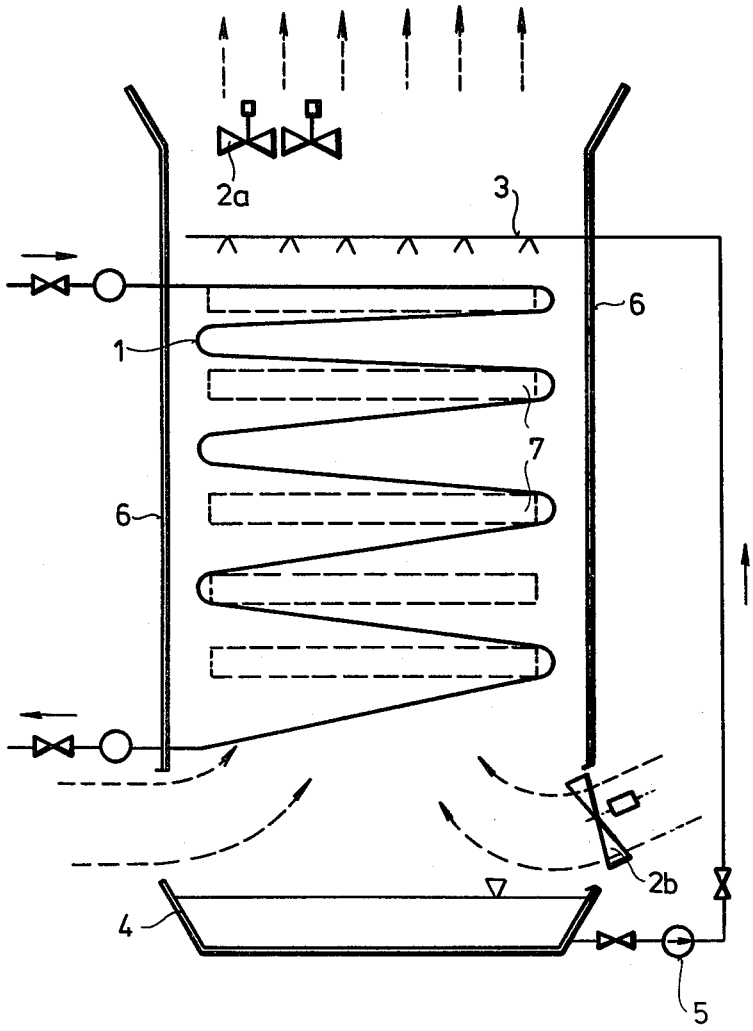

The invention relates to a heat exchanger, the heat exchanging surfaces of which consist of a coil pipe with a changing angle of inclination and of secondary surfaces which are functionally connected to the same. With heat exchangers built up of pipes, in the inside of the pipes a condensing medium, f.i. water vapour flows, while on the outer surface of the pipes another medium, e.g. a liquid or ambient air flows. With these heat exchangers, in order to save water, nowadays mostly air is used for cooling purposes. However, the heat transfer coefficient between the air and the pipe is smaller by an order of magnitude, than the heat transfer coefficient of condensation inside the pipe, accordingly a small amount of water is sprayed onto the outer surface of the pipe, whereas an air flow is induced between the pipes. A part of the water evaporates and exerts a cooling effect on the pipe surface. The remaining part of the water flows to the space beneath the heat exchanger, whence it is recirculated via the pump to the space over the coil pipe. In such a manner the cooling process requires considerably less water; between the pipe and the air an evaporating and convective phenomenon may be observed, so we are confronted with a combined heat transfering process.

In the known constructions used for this process, either one pipe row is arranged or several, approximately horizontally arranged parallel pipes are connected in series forming a coil pipe. The condensing medium, e.g. ammonia vapour is led into the upper row of the coil pipe. In the pipe rows lying beneath each other the medium gradually condenses and the condensate formed flows towards the lowest pipe. The coil pipe is arranged in a casing, the ventilators having been arranged on the top or on the bottom thereof putting the cooling air into motion.

The common drawback of the known solutions lies in that the condensate accumulates in a continuously increasing quantity in the pipes lying beneath each other and completely fills the cross-section of the lowest pipe, accordingly, here condensation cannot take place.

A further drawback of the known solutions lies in that compared to the utmost advantageous heat transfer coefficient within the pipes, there is a considerable difference between the heat transfer coefficient of the outer convection and the evaporation, respectively, as a consequence, relatively large heat surfaces have to be used.

In order to be able to eliminate the drawbacks mentioned above, either the outer heat transfer coefficient has to be increased by increasing the velocity of air and the output of the ventilator, or the temperature difference between the pipe wall and the spray water has to be increased by spraying colder water onto the pipe surface.

The solution according to the invention is based on these phenomena; here the inclination of the pipes changes in compliance with the prevailing conditions of condensation, i.e. the angle of inclination is increased, as the pipes tend downwards.

Furthermore, means for the improvement of heat transfer are provided by the supplementary surfaces. This latter solution is based on the recognition, that spray water need not be evaporated exclusively on the surface of the pipes with a large wall-thickness because of the internal pressures and thus representing expensive components, but instead the water may be cooled in an easier and cheaper manner on the supplementary surfaces connected to the pipes in an advantageous manner from the point of view of fluid mechanics.

In the invention the supplementary surfaces are formed in such a manner, that they do not restrict the path of the air flowing upwards, at the same time water should be collected from the pipes and sprayed onto the surfaces. For this reason the supplementary surfaces are formed with a low resistance; that means, that the dimension lying perpendicularly to the stream is as small as possible, expendiently less than the one tenth of the pipe diameter. For the magnitude of the supplementary surfaces an optimal proportion between the surface of the pipe $/f_p/$ and the supplementary surface $/f_s/$ is $f_s/f_p=2$.

In order to be able to reduce air flow resistance, expediently the pitch of the supplementary surfaces is co-ordinated with the diameter of the pipes, i.e. the O pitch should be chosen as a multiple of the quarter of the pipe diameter, D/4.

In the arrangement according to the invention the optimal inclination of the pipes can be obtained in the following manner: among the pipes lying beneath each other the angle of inclination of the lowest pipe lies in the range between 0° and 30° in dependence of the cross-section of the pipe, while the angle of inclination of the following pipe is progressively upwardly reduced by 3° to 5°, accordingly, supposing, that the angle of inclination at the lowest pipe amounts to 30°, that of the second from below it equals 25°, the third 20°, the fourth 15° and so forth, up to 5°.

Figure 2:
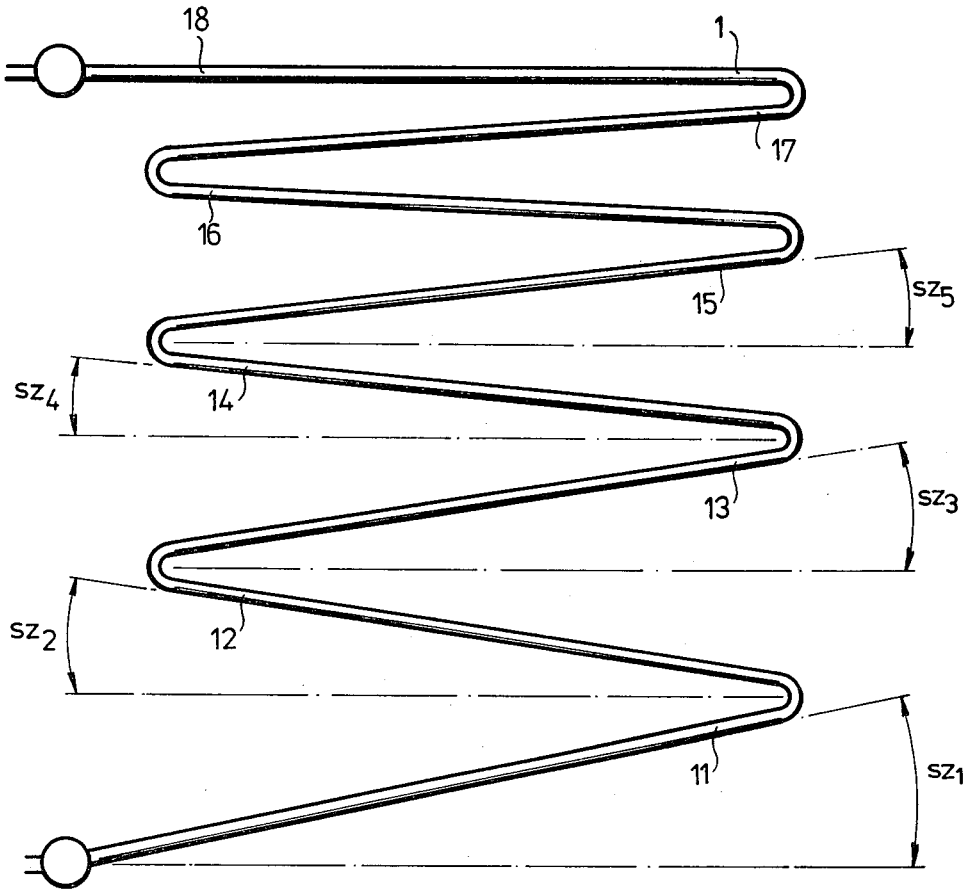
Figure 3:
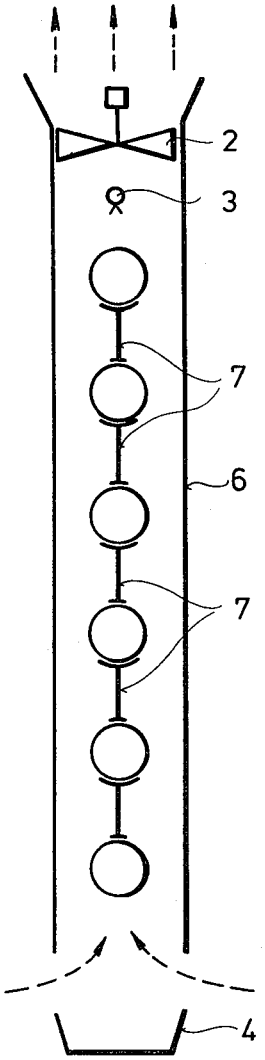
Figure 4:
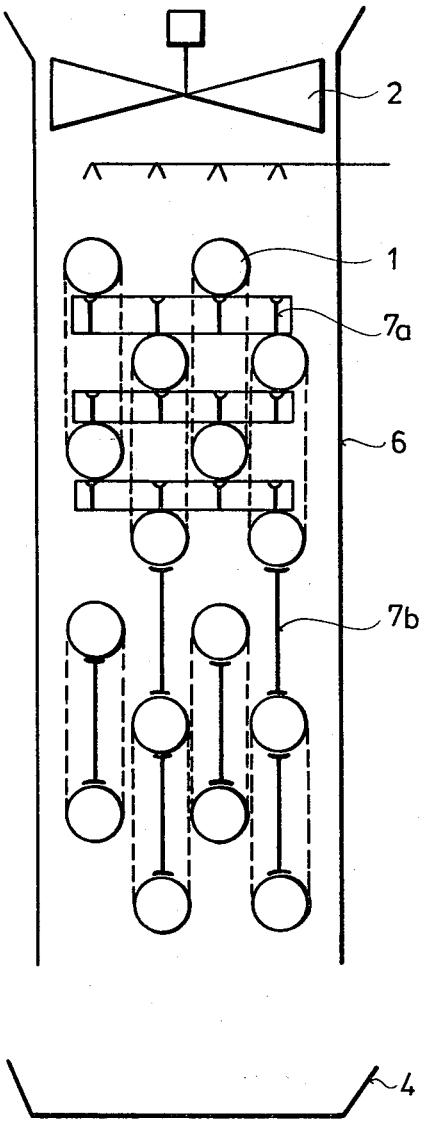
Figure 5:
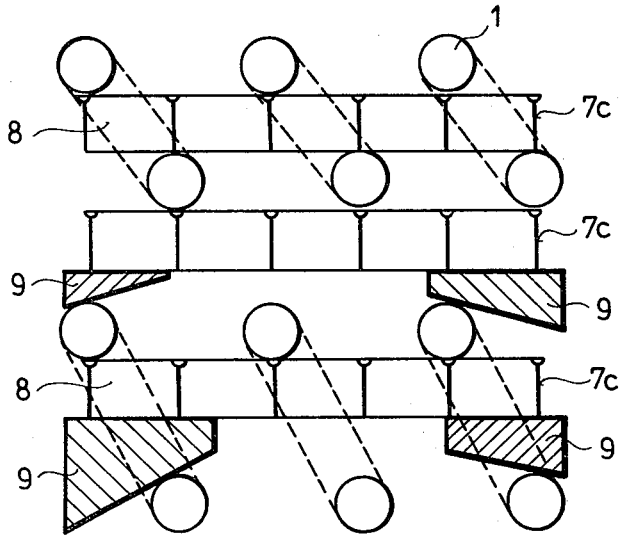
Figure 6:
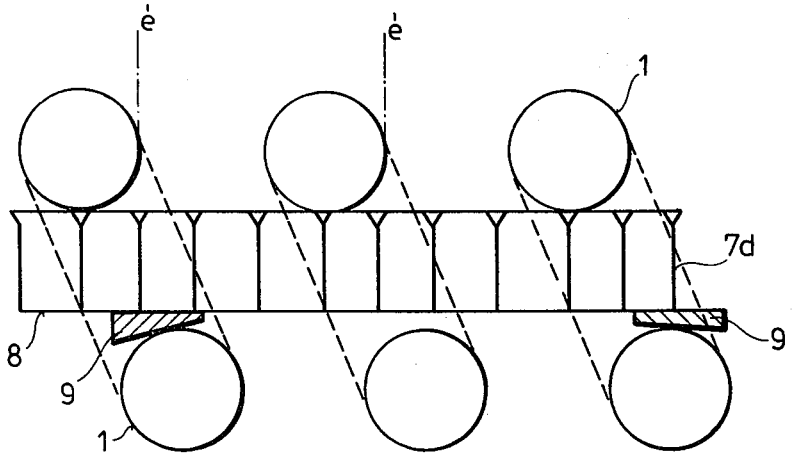
Figure 7:
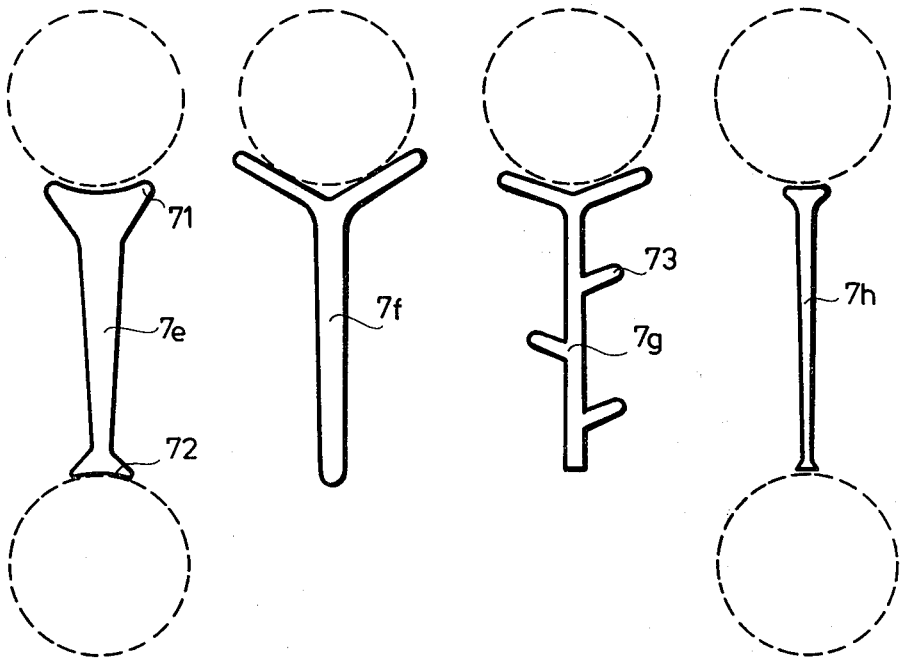

The invention will be described in detail by means of preferred embodiments, by the aid of the accompanying drawings, wherein FIG. 1 is a schematic view of the construction of the heat exchanger, FIG. 2 shows the inclination of the coil pipe of the heat exchanger, FIG. 3 shows a cross-section of the coil pipe of the heat exchanger and the supplementary surfaces in an arrangement with one single row of pipes, FIG. 4 is a view similar to FIG. 3 but with two rows of pipes displaced in relation to each other, FIG. 5 is a partial section of the coil pipe of the heat exchanger with three rows of pipes displaced in relation to each other, FIG. 6 shows one of the possible versions for the arrangement of the supplementary surfaces connected to the coil pipe of the heat exchanger, FIG. 7 shows four further possible embodiments of the supplementary surfaces connected to the coil pipe of the heat exchanger.

FIG. 1 shows an embodiment of the heat exchanger according to the invention. Condensation of one of the media taking part in the heat exchange takes place in the continuous coil pipe 1. Along the outer surface of the coil pipe the air stream—induced by the ventilators 2*a*, 2*b*—flows upwards, and water—sprayed by means of the sprayer 3 onto the pipes—flows downwards. The water sprayed onto the pipes and flowing therefrom is collected in the drip pan 4, from here the water is recirculated to the sprayer 3 via the pump 5. The construction is housed in a casing 6. The supplementary surfaces 7 according to the invention are arranged between the heat exchanging pipes. From the figures it becomes obvious, that the angle of inclination of the heat exchanging pipes increases progressively downwardly.

In FIG. 2 the change of the angles of inclination of the coil pipe 1 has been illustrated. The inclination of the lowest row 11 of pipes is the largest, e.g. the angle of inclination ($sz_1$) amounts to 30°, the angle of inclination ($sz_2$) of the next row 12 equals 25°, the angles of inclination of the following rows 13, 14, 15, 16 equal 20°, 15°, 10°, 5°, while the angle of inclination of the final rows 17, 18, remains constant, e.g. 5°.

In FIG. 3 the coil pipe according to the invention is to be seen, similarly to the previous embodiment there are the ventilator 2, the sprayer 3, the drip pan 4, the casing 6, simultaneously the cross-section of the supplementary surfaces is also shown. It can be seen, that the supplementary surfaces form an organic unit with the coil pipe in respect to fluid mechanics, they do not restrict the path of the air streaming upwards, simultaneously they ensure the accumulation of the water having been sprayed thereon and lead it forward to the next row of pipes.

In FIG. 4 the arrangement incorporating two parallel coil pipe rows displaced in relation to each other, mlay be seen, showing two possible embodiments of the supplementary surfaces *7a, 7b.* The common characteristics lie in, that in both cases the surfaces are arranged directly below the pipes. The supplementary surface *7a* may be arranged between two adjacent pipes of the coil pipe displaced in relation to each other, while the supplementary surface *7b* fills out the space between two pipes arranged below each other.

In FIG. 5 another possible arrangement of the supplementary surfaces may be seen; the surfaces *7c* extend in a horizontal direction and do not contact directly the pipes, not even their lower flanges contact the pipes lying underneath. The supplementary surfaces are fixed by means of the wedges 9 of the required dimension, which are arranged between the fastening laths 8 and the pipes. In such a manner the supplementary surfaces can be formed with identical heights despite the fact that according to the invention the angles of inclination of the pipes—in particular at the bottom—are different and as a consequence, the gap between them also changes.

In FIG. 6 an embodiment of the supplementary surfaces is to be seen, wherein the surfaces *7d* may be arranged not only below the lower edge of the pipes, but also below the outer edges thereof. Such a solution should be used in cases, when a large quantity of water is sprayed onto the pipes and it may happen that the water film is dislodged at the outer rims of the pipes.

Finally, in FIG. 7 the possible versions of the cross-sections of the supplementary surfaces 7 may be seen. As to the surface *7e*—which is in direct contact with the pipe—the upper arch 71 and the lower arch 72 are identical with the radius of the pipe.

In case of the supplementary surface *7f* the upper part of said surface is parallel with the tangent of the pipe lying above it.

The side of the supplementary surface *7g* is provided with the complementary surfaces 73 for collecting the water. The supplementary surfaces *7h* merely touch the pipes lying below and above said surfaces.

What we claim is:

1. In a heat exchanger for the condensation of vapors, comprising a coil pipe having an upper inlet end and a lower outlet end and a plurality of lengths of pipe arranged in zigzag fashion between said upper and lower ends, means to spray liquid from above onto the coil pipe, and means to move air upwardly along the coil pipe; the improvement in which said lengths of pipe are inclined downwardly at acute angles to the horizontal from said inlet end to said outlet end and said acute angles progressively increase downwardly such that the angles between pairs of adjacent lengths of pipe progressively increase downwardly for a plurality of said pairs.

2. A heat exchanger as claimed in claim 1, in which the angle to the horizontal of the lowermost length of pipe is not more than 30°.

3. A heat exchanger as claimed in claim 2, in which the angle of inclination of the pipe lengths increases stepwise by increments of 3°–5°.

4. A heat exchanger as claimed in claim 1, in which the angle of inclination of the pipe lengths increases stepwise by increments of 3°–5°.

5. A heat exchanger as claimed in claim 1, in which the angle to the horizontal of the uppermost length of pipe is 3°–5°.

6. A heat exchanger as claimed in claim 1, and vertical strips of plate disposed between said lengths of pipe.

7. A heat exchanger as claimed in claim 6, said strips and lengths of pipe being disposed in a common vertical plane.

8. A heat exchanger as claimed in claim 6, in which the outer surface of a said strip is about twice the outer surface of said pipe lengths.

* * * * *